US006269803B1

(12) United States Patent
Corkill

(10) Patent No.: US 6,269,803 B1
(45) Date of Patent: Aug. 7, 2001

(54) ONBOARD DIAGNOSTICS FOR VEHICLE FUEL SYSTEM

(75) Inventor: William John Corkill, Leics (GB)

(73) Assignee: Jaguar Cars Limited, Allesley (GB)

( * ) Notice: Subject to any disclaimer, the term of this patent is extended or adjusted under 35 U.S.C. 154(b) by 0 days.

(21) Appl. No.: 09/510,986

(22) Filed: Feb. 22, 2000

(51) Int. Cl.[7] ..... F02N 33/04
(52) U.S. Cl. ..... 123/520
(58) Field of Search ..... 123/516, 518, 123/519, 520, 196 D

(56) References Cited

U.S. PATENT DOCUMENTS 5,460,143 * 10/1995 Narita ..... 123/520
5,463,998 * 11/1995 Denz et al. ..... 123/520
5,575,265 * 11/1996 Kurihara et al. ..... 123/520
5,765,540 * 6/1998 Ishii et al. ..... 123/520
6,016,792 * 1/2000 Kawano et al. ..... 123/520
6,105,556 * 8/2000 Takaku et al. ..... 123/520

* cited by examiner

*Primary Examiner*—Thomas N. Moullis
(74) *Attorney, Agent, or Firm*—Jerome R. Drouillard

(57) ABSTRACT

A vehicle fuel system has on-board diagnostics for vapor integrity testing. The vapor integrity test includes evacuating the fuel system; closing the system and allowing pressure to rise due to air ingress and vapor generation (bleedup); making a series of pressure measurements at intervals during bleedup to give a series of timed pressure values; and calculating vapor rate from values derived from the pressure values. Vapor integrity may be calculated from the same values representing pressure gradient and the rate of change of pressure gradient or the vapor rate may be used as a correction to vapor integrity derived by other means.

2 Claims, 1 Drawing Sheet

ONBOARD DIAGNOSTICS FOR VEHICLE FUEL SYSTEM

FIELD OF THE INVENTION

This invention relates to a vehicle fuel system having on-board diagnostics for testing the system for vapor integrity.

BACKGROUND OF THE INVENTION

Vehicle fuel systems are required to control emission of fuel vapor. This is done by collecting vapor emitted from the fuel tank in a purge canister containing carbon to absorb the vapor. The canister is purged of collected vapor when the engine is running by drawing air through the canister into the engine, relying on manifold vacuum. The system is sealed except for venting to the atmosphere via the purge canister. On-board testing is required to ensure that escape of vapor from the sealed system does not exceed prescribed limits. Typical known vapor integrity testing systems are described U.S. Pat. Nos. 5,333,590 and 5,765,121.

The latter patent describes a basic test in which the manifold vacuum is used to pump out the fuel tank and the return of tank pressure to atmospheric ("bleedup") is monitored. If bleedup exceeds a certain threshold value R the system is determined to have an unacceptable vapor integrity. If the bleedup is less than R, it assumed that vapor integrity is acceptable. Vapor loss below a certain level cannot be reliably detected with this basic system because vapor generation from fuel in the tank can cause pressure in the evacuated system to recover more rapidly than ingress of air due where loss of vapor integrity is small.

Vapor generation depends on many factor, including ambient temperature and vapor volume, that is the volume of free space above the fuel tank and in the purge canister and connecting passages. Vapor volume is itself directly related to fuel level.

Thus, in order to improve the sensitivity of the basic bleedup test, measures must be taken to correct for different operating conditions, particularly the fuel level and the rate of vapor generation in the tank.

For example, U.S. Pat. No. 5,333,590 uses a threshold value R which is not fixed but is related to vapor volume and fuel temperature.

It is also known to improve the sensitivity of vapor integrity testing by using a two stage test. The first stage is a bleedup test in which pressure increase over a certain period (period_A) is measured. A second stage is carried out in which pressure rise of the closed system from atmospheric over a second period (period_B) is monitored. The second stage gives an indication of vapor generation in the tank under prevailing conditions. A constant scaling factor is used to deduct a proportion of pressure rise found during the second stage to provide a value which more closely represents the level of bleedup due to ingress of air into the tank during the first stage of the test.

SUMMARY OF THE INVENTION

According to the present invention a vehicle fuel system with on-board diagnostics for vapor integrity testing comprises a vehicle fuel system with on-board diagnostics for vapor integrity testing comprising: a) a fuel tank for containing fuel for delivery to an internal combustion engine; b) a purge canister connected to the space in the tank above the fuel; c) a canister vent valve (CVV) for connecting the purge canister to the atmosphere; d) a purge valve for connecting the purge canister to the engine; and e) an electronic control unit (ECU) arranged for monitoring pressure and fuel level in the tank and other engine, vehicle and ambient conditions and for controlling opening and closing of the valves; f) the CVV and the purge valve being controlled by the ECU for venting the tank to atmosphere via the purge canister (purge valve closed, CVV open), and for purging vapor from the canister by allowing air to be drawn through the canister by manifold vacuum (both valves open); g) the ECU being arranged to carry out a periodic vapor integrity test, when the engine is running, the vapor integrity test including (i) reducing the pressure in the tank, closing the system and allowing pressure in the system to recover towards atmospheric (bleedup), (ii) making a series of pressure measurements at intervals during bleedup to give a series of timed pressure values and (ii) calculation of vapor rate from values representing pressure gradient and the rate of change of pressure gradient derived from the pressure values.

The improved fuel system test contemplated by the invention is preferably implemented using the vehicle's existing electronic engine control unit and the fuel system pressure sensor which is used for other purposes. As a consequence, the benefits of the invention may be obtained at very little additional cost.

These and other features and advantages of the present invention may be better understood by considering the following detailed description of a preferred embodiment of the invention.

During the course of this description, frequent reference will be made to the attached drawings.

DESCRIPTION OF THE PREFERRED EMBODIMENT

Figure 1:
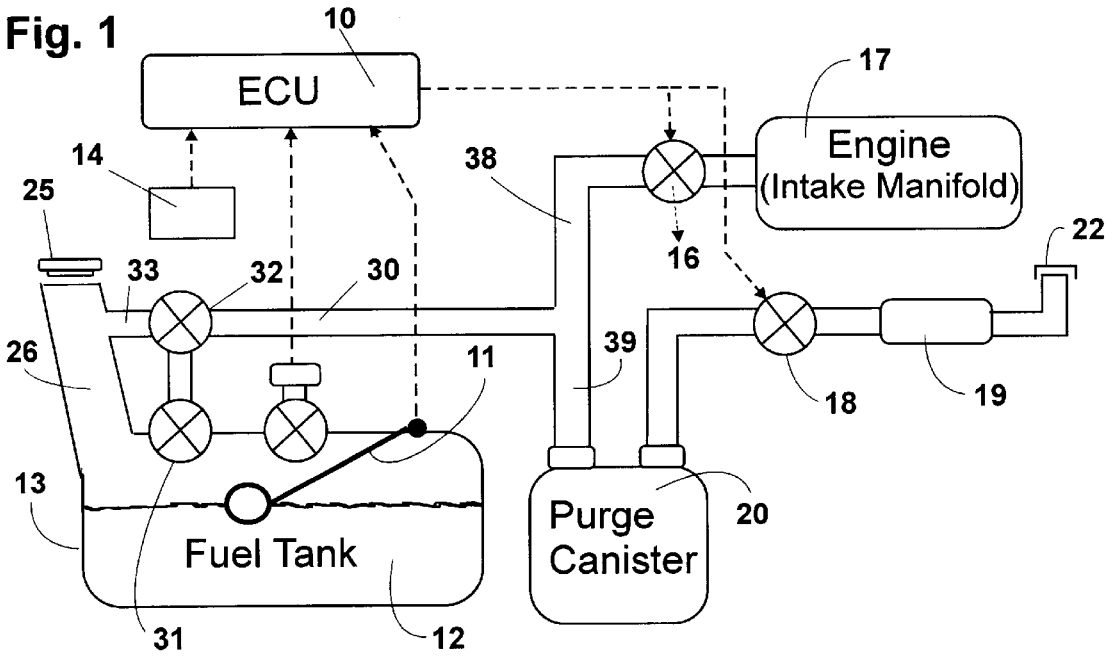
FIG. 1 is a schematic diagram of a vehicle fuel system with on-board diagnostics for vapor integrity testing which utilizes the principles of the invention.

A diagnostic procedure for vapor integrity testing is performed automatically at predetermined intervals by an electronic control unit (ECU) 10 seen in FIG. 1. The test is aborted if prevailing conditions (fuel sloshing, heavy acceleration etc) are such that a reliable test result cannot be expected.

The ECU 10 is connected to a fuel sender 11 for sensing the level of fuel 12 in a fuel tank 13, an ambient temperature transducer 14, and a fuel tank pressure transducer 15.

The ECU controls a vapor management valve (VMV) 16 and a normally open canister vent valve (CVV) 18. The CVV controls the air flow through a filtered passageway 19 which connects a purge canister 20 containing charcoal for absorbing fuel vapor to an atmospheric vent 22. The VMV 16, when open, connects the purge canister 20 to the intake manifold 17 of the vehicle engine via lines 38 and 39.

The closed fuel system seen in FIG. 1 further includes a vacuum/pressure relief valve within a cap 25 which closes the fuel inlet passageway 26 of the fuel tank 13. A passageway 30 extends from a rollover valve 31 at the top of the tank 13 to both the purge canister 20 and the VMV 16. A running-loss vapor control valve 32 connects the passageway 30 to the upper portion of the fuel inlet passageway 26 via a branch passageway 33.

When the vehicle engine in not running the ECU closes the VMV 16 and opens the CVV 18 so that fuel vapor is absorbed by carbon in the purge canister before reaching the atmosphere. Moreover, air may enter the fuel system via the purge canister 20 if pressure in the tank falls below atmospheric due to condensation of vapor. When the engine is running, the ECU from time to time opens both VMV 16 and CVV 18 so that air is drawn through the purge canister by manifold vacuum to purge fuel vapor from the canister.

Figure 2:
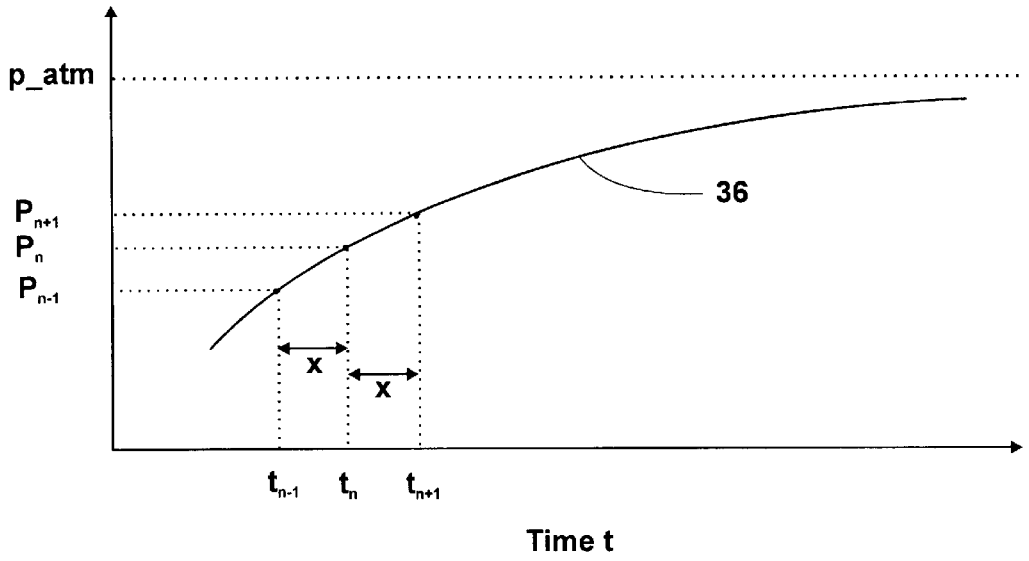
FIG. 2 is a graph of pressure changes which take place in a vapor integrity test carried out in the system shown in FIG. 1, showing some of the pressure values obtained for use in vapor and air ingress calculations.

The diagnostic vapor integrity testing procedure includes an evacuation phase in which the ECU closes the CVV 18 and opens the VMV 16 so that air and vapor are pumped out of the tank 13 and canister 20 by manifold vacuum until a desired pressure is achieved. The evacuation phase is followed by a holding stage of several seconds. After the holding phase, the ECU closes both the VMV 16 and the CW 18, sealing the system. The tank pressure as indicated by the pressure sensor 15 is monitored by the ECU during a bleedup phase 36, illustrated in FIG. 2.

During the bleedup phase of the vapor integrity test, a series of pressure values $P_1$ $P_2$ $P_3$ . . . $P_m$ are measured at known intervals of time (every x seconds). In accordance with a preferred embodiment of the invention, a series of calculations are carried out, each calculation using three successive pressure values $P_{n-1}$ $P_n$ $P_{n+1}$ (see FIG. 2). Each such calculation provides calculated values for both the hole size and the rate of vapor generation and discriminates between the contribution of each to the pressure change.

Depending on the robustness of this procedure, in practice, the data gathered during this stage may provide all the information required to estimate the hole size with confidence.

Alternatively, it may provide an indication of vapor rate which can then be used to improve the accuracy of a conventional vapor integrity test procedure or indicate a test abort condition if vapor rate changes significantly during the test.

The calculation of vapor rate and hole size may be based on isothermal conditions (constant temperature, polytropic index=1) or can include a temperature factor reflecting the ratiometric change of fuel vapor temperature within the tank. The principle of continuous calculation of vapor and hole size with, or without, a temperature factor, is described below. An algorithm for predicting tank temperature ratio is described in our co-pending application No., the whole subject matter of which is incorporated herein by reference. Temperature prediction as described in the co-pending application is preferred to the use of a temperature sensor for direct measurement of vapor temperature since a temperature sensor would add significant cost and require its own diagnostics.

Calculation Procedure

Nomenclature:

x data sampling interval period total stage duration m number of data samples=period/x+1 n data sample calculation number (1<n<m)

T gas temperature $T_1$ $T_2$ $T_3$ . . . $T_m$

P sampled gas depression $P_1$ $P_2$ $P_3$ . . . $P_m$ k1 constant $Q_n$ instantaneous vapor rate at sample n d calculated hole diameter V fuel tank vapor volume Each stage of the calculation requires 3 consecutive data samples and, therefore, calculation can take place throughout the test duration commencing at the third sample and ending at the last sample. Alternatively all the data can be processed after completion of the stage.

The minimum number of samples required is 3, at t=0, t=period/2 and t=period, permitting 1 calculation. There is no upper limit to the number of samples although practical considerations of computing resource and signal noise will naturally limit this.

Calculation Step

At each calculation step (n) between n=2 and n=m−1:

1) estimate polytropic index np:

$$np1=(P_{n+1}-P_{n-1})/(P_{n+1}+P_{n-1})$$

$$np2=(T_{n+1}-T_{n-1})/(T_{n+1}+T_{n1})$$

$$np=np1/(np1-np2) \text{ if temperature factor included}$$

else np=1

2) calculate instantaneous vapor rate $$k2=V/np/(P_atm-P_n)$$

$$G_n=P_{n+1}-P_{n-1}$$

where $G_n$ is a function of mean pressure gradient over the period $t_{n-1}$ to $t_{n+1}$;

$$C_n=P_{n+1}-2.P_n+P_{n-1}$$

where $C_n$ is a function of the rate of change of pressure over the period $t_{n-1}$ to $t_{n+1}$;

$$d2=-4*k2*C_n*P_n^{1/2}/x/G_n$$

$$Q_n=-k2*G_n/2/x-d2*P_n^{1/2}$$

3) calculate hole diameter $$d_n=\sqrt{(d2/k1)}$$

Application of Strategy

In its simplest form, the calculation can be carried out at only one point, using 3 samples at the start, middle and end of the period. In this case the value of Q will be the mean value vapor rate over the stage. Any fluctuations in Q during the stage will influence the calculated hole size.

Alternatively, the use of more data points will enable the changes in Q to be monitored throughout the stage. In this case the successive values of calculated diameter dn can be averaged or processed using smoothing routines to converge on a final value, for example:

$$d_n=d_n*f+d_{n-1}*(1-f)$$

The use of too many samples is to be avoided; the values of pressure related variables $C_n$ and $G_n$ will become sensitive to noise on the signal from pressure transducer 15.

It is to be understood that the embodiment of the invention described above is merely illustrative on one application of the principles of the invention. Numerous modifications may be made to the methods and apparatus described without departing from the true spirit and scope of the invention.

What is claimed is:

1. A vehicle fuel system with on-board diagnostics for vapor integrity testing comprising:

a) a fuel tank for containing fuel for delivery to an internal combustion engine;

b) a purge canister connected to the space in the tank above the fuel;

c) a canister vent valve (CVV) for connecting the purge canister to the atmosphere;

d) a purge valve for connecting the purge canister to the engine; and e) an electronic control unit (ECU) arranged for monitoring pressure and fuel level in the tank and other engine, vehicle and ambient conditions and for controlling opening and closing of the valves;

f) the CVV and the purge valve being controlled by the ECU for venting the tank to atmosphere via the purge canister (purge valve closed, CVV open), and for purging vapor from the canister by allowing air to be drawn through the canister by manifold vacuum (both valves open);

g) the ECU being arranged to carry out a periodic vapor integrity test, when the engine is running, the vapor integrity test including (i) reducing the pressure in the tank, closing the system and allowing pressure in the system to recover towards atmospheric (bleedup), (ii) making a series of pressure measurements at intervals during bleedup to give a series of timed pressure values and (iii) calculation of vapor rate and vapor integrity from values, as well as calculation of the polytropic index for the vapor in the system using the pressure values and corresponding temperature values, each temperature value representing instantaneous vapor temperature at the time of the corresponding pressure value, and using the polytropic index as factor in the calculation of vapor rate.

2. A method of vapor integrity testing for a vehicle fuel system including the following steps:

i) evacuating the fuel system;

ii) closing the system and allowing pressure to rise due to air ingress and vapor generation (bleedup);

iii) making a series of pressure measurements at intervals during bleedup to give a series of timed pressure values while calculating the polytropic index for the vapor in the system using the pressure values and corresponding temperature values, each temperature value representing instantaneous temperature at the time of the corresponding pressure value;

(iv) calculating vapor rate from the polytropic index, and from values representing pressure gradient and the rate of change of pressure gradient derived from the pressure values; and (v) calculating vapor integrity from said values representing pressure gradient and the rate of change of pressure gradient.

* * * * *